US009483963B2

(12) United States Patent
Woelfel et al.

(10) Patent No.: US 9,483,963 B2
(45) Date of Patent: Nov. 1, 2016

(54) DISPLAY ASSEMBLY AND SYSTEM FOR PAINT SAMPLE CARDS

(71) Applicant: Behr Process Corporation, Santa Ana, CA (US)

(72) Inventors: Erika Woelfel, Irvine, CA (US); Mark Germain, Long Beach, CA (US); Amy Tow Harmon, Huntington Beach, CA (US); Sarah Furnari, Costa Mesa, CA (US); Joel Barenbrugge, Naperville, IL (US); Michael J. Ebert, Genoa, IL (US); Thomas E. Hubley, Fox River Grove, IL (US); Jeffrey B. Fridrich, Chicago, IL (US)

(73) Assignee: Behr Process Corporation, Santa Ana, CA (US)

( * ) Notice: Subject to any disclaimer, the term of this patent is extended or adjusted under 35 U.S.C. 154(b) by 55 days.

(21) Appl. No.: 14/132,884

(22) Filed: Dec. 18, 2013

(65) Prior Publication Data

US 2015/0170552 A1 Jun. 18, 2015

(51) Int. Cl.
*G09F 5/04* (2006.01)
*A47F 7/14* (2006.01)
(Continued)

(52) U.S. Cl.
CPC ..... *G09F 5/04* (2013.01); *A47F 5/105* (2013.01); *A47F 7/0042* (2013.01); *A47F 7/146* (2013.01)

(58) Field of Classification Search
CPC ..... G09F 5/04; G09F 1/10; G09F 5/00; A47F 7/146; A47F 7/144; A47F 7/145; A47F 7/0014; A47F 7/0042; A47F 5/105; A47F 7/147; A47F 7/0057; A47F 7/14; A47F 7/143; A47F 7/16; A47F 7/163; A47F 3/14; A47F 5/0062; A47F 5/0025
USPC ..... 211/55, 50, 51, 52, 128.1, 126.13, 49.1, 211/40, 54.1, 184, 150, 43, 72, 96, 169, 211/169.1; 40/124, 124.2, 124.4; 312/128, 312/234, 118, 50, 107, 108; 434/98
See application file for complete search history.

(56) References Cited

U.S. PATENT DOCUMENTS 1,456,401 A * 5/1923 Powell ..... G09F 5/04 206/391
1,589,218 A * 6/1926 Pinten ..... A47F 7/145 206/742

(Continued)

FOREIGN PATENT DOCUMENTS

CA 886097 A 11/1971
DE 20112803 U1 1/2003

(Continued)

OTHER PUBLICATIONS

Officehomedesign.com, Lowes Paint Color Chart, 2013, 5 pages.

(Continued)

*Primary Examiner* — Joshua Rodden
*Assistant Examiner* — Hiwot Tefera
(74) *Attorney, Agent, or Firm* — Brooks Kushman P.C.; Lora Graentzdoerffer

(57) ABSTRACT

A display assembly is provided with a base, and a plurality of receptacles supported by the base. Each of the plurality of receptacles is sized to receive a plurality of cards. Each of the plurality of receptacles has a distal end with an opening for display, receipt and removal of at least one of the plurality of cards and a proximal end to provide a limit to a depth of receipt for the plurality of cards within the receptacle. Each receptacle is oriented such that a direction from the distal end to the proximal end is angularly offset from vertical about a fore/aft axis relative to the base for customer access of at least one of the plurality of cards. Multiple arrays of receptacles are provided with a central array having a quantity of receptacles that is different than the other arrays to create a non-rectangular overall profile.

16 Claims, 4 Drawing Sheets

(51) Int. Cl.
*A47F 5/10* (2006.01)
*A47F 7/00* (2006.01)

(56) References Cited

U.S. PATENT DOCUMENTS 2,409,285 A * 10/1946 Jacobson ..... G01J 3/52 434/98
2,890,530 A 6/1959 Goldsholl et al.
3,070,905 A 1/1963 Gaudier-Pons
3,120,065 A 2/1964 Gaudier-Pons
3,224,113 A 12/1965 Goldsholl
3,384,983 A * 5/1968 Olson ..... G01J 3/52 434/98
3,517,448 A 6/1970 Wallace
3,821,538 A * 6/1974 Jonathan et al. ..... 362/127
3,886,348 A * 5/1975 Jonathan et al. ..... 362/127
4,003,470 A 1/1977 Lagorio et al.
4,102,072 A * 7/1978 Buschman ..... 40/124.2
4,217,985 A 8/1980 Nasgowitz
4,265,038 A 5/1981 Crosslen
4,379,696 A 4/1983 Lerner
4,457,718 A 7/1984 Lerner
D288,038 S 2/1987 Henning
4,645,075 A * 2/1987 Van der Lely ..... G11B 23/0236 206/387.15
4,684,030 A * 8/1987 Gurzynski ..... A47F 7/146 211/40
4,706,396 A * 11/1987 Nomura ..... B42F 7/06 40/124.2
4,744,473 A * 5/1988 Hardy ..... A47B 87/0246 206/509
4,899,886 A * 2/1990 Johansen ..... 206/555
4,964,519 A * 10/1990 Sugarman et al. ..... 211/50
4,982,852 A 1/1991 Johansen
5,046,616 A * 9/1991 Makowski ..... B65D 73/0007 206/455
5,222,609 A * 6/1993 Eaton ..... 211/55
5,312,001 A 5/1994 Sorensen
D353,066 S 12/1994 Brandenberg
5,678,699 A * 10/1997 Gebka ..... 211/57.1
6,006,927 A 12/1999 Levy
6,213,313 B1 * 4/2001 Levy ..... 211/51
D459,117 S 6/2002 Singh
D460,785 S 7/2002 Rice
D460,986 S 7/2002 Rice
6,416,612 B1 7/2002 Lerner et al.
D461,508 S 8/2002 Rice
D461,848 S 8/2002 Rice
D462,720 S 9/2002 Rice
D466,159 S 11/2002 Rice
D470,191 S 2/2003 Rice
6,533,130 B1 3/2003 Padiak et al.
6,578,718 B2 6/2003 Levy
D476,509 S 7/2003 Orsino et al.
D481,882 S 11/2003 Richardson et al.
D481,883 S 11/2003 Richardson et al.
D481,884 S 11/2003 Richardson et al.
D482,207 S 11/2003 Richardson et al.
D482,905 S 12/2003 Peyker
D488,001 S 4/2004 Richardson et al.
D488,318 S 4/2004 Richardson et al.
D488,633 S 4/2004 Richardson et al.
D488,937 S 4/2004 Gillet
D493,045 S 7/2004 Richardson et al.
D497,269 S 10/2004 Richardson et al.
D497,495 S 10/2004 Richardson et al.
D498,087 S 11/2004 Stein
6,811,046 B2 * 11/2004 Stein ..... 211/169
6,994,553 B2 2/2006 DaRif et al.
7,005,171 B2 2/2006 Lerner et al.
D519,115 S 4/2006 Lee et al.
D524,573 S 7/2006 Robinson et al.
D526,819 S 8/2006 Lee et al.
D527,207 S 8/2006 Lee et al.
D527,934 S 9/2006 Lee et al.
D528,835 S 9/2006 Lee et al.
D532,416 S 11/2006 Lee et al.
7,204,376 B2 4/2007 Richardson et al.
D549,003 S 8/2007 Biser
D557,041 S 12/2007 Lee et al.
D557,543 S 12/2007 Hanson
7,308,987 B2 12/2007 Richardson et al.
7,360,915 B2 4/2008 Richardson et al.
7,571,823 B2 8/2009 Richardson et al.
7,604,132 B2 10/2009 Richardson et al.
7,641,474 B2 1/2010 Rice
7,789,472 B2 9/2010 Richardson et al.
D627,989 S 11/2010 Geoffrey
D631,678 S 2/2011 Morison
D631,679 S 2/2011 Woelfel
D641,986 S 7/2011 Giroux et al.
D641,987 S 7/2011 Giroux
D641,988 S 7/2011 Giroux
D641,989 S 7/2011 Giroux et al.
D641,990 S 7/2011 Giroux
D641,991 S 7/2011 Giroux
D641,992 S 7/2011 Giroux et al.
D642,399 S 8/2011 Giroux et al.
7,992,330 B2 * 8/2011 DaRif et al. ..... 40/124.4
D649,930 S 12/2011 Lindor
D665,190 S 8/2012 Fitzpatrick
8,312,998 B2 11/2012 Theisen
8,319,788 B2 11/2012 Buzyn et al.
D677,938 S 3/2013 Peterson
D679,922 S 4/2013 Weigand
8,517,267 B2 8/2013 Reynolds et al.
D693,158 S 11/2013 Jung et al.
2002/0092221 A1 7/2002 DaRif et al.
2004/0181981 A1 9/2004 DaRif et al.
2005/0006332 A1 * 1/2005 Stein ..... 211/169
2005/0155943 A1 7/2005 Butcher et al.
2006/0121231 A1 6/2006 Lerner et al.
2006/0131250 A1 6/2006 Richardson et al.
2006/0186063 A1 * 8/2006 Campbell ..... 211/55
2007/0109315 A1 5/2007 Rice
2008/0209778 A1 * 9/2008 DaRif et al. ..... 40/124.2
2010/0314345 A1 12/2010 Hodge
2011/0266337 A1 * 11/2011 Reynolds et al. ..... 235/375
2012/0080985 A1 4/2012 Alarcon et al.
2012/0217360 A1 8/2012 Fanning, Jr. et al.
2012/0325994 A1 * 12/2012 Mansfield ..... A47F 5/0853 248/223.41
2013/0284802 A1 10/2013 Reynolds et al.
2015/0122753 A1 5/2015 Fanning, Jr. et al.

FOREIGN PATENT DOCUMENTS

DE 202005008387 U1 7/2005
DE 102009046550 A1 5/2011
EP 1862096 A2 12/2007
GB 2399934 A 9/2004
RU 2253342 C2 6/2005

OTHER PUBLICATIONS

U.S. Design Application and Drawings for U.S. Appl. No. 29/476,933, filed Dec. 18, 2013, 5 pages.
Written Opinion for Chile Application No. 3456-2014, mailed Aug. 22, 2016, 10 pages.

* cited by examiner

DISPLAY ASSEMBLY AND SYSTEM FOR PAINT SAMPLE CARDS

TECHNICAL FIELD

Various embodiments relate to display assemblies and systems for paint sample cards and retail of paint.

BACKGROUND

The prior art has offered paint sample cards, also referred to as paint chips. The paint sample cards are often displayed at a point-of-sale to display various colors that are offered at retail.

SUMMARY

According to at least one embodiment, a display assembly is provided with a base having a front for customer access and a rear. A plurality of receptacles is supported by the base. Each of the plurality of receptacles is sized to receive a plurality of cards. Each of the plurality of receptacles has a distal end with an opening for display, receipt and removal of at least one of the plurality of cards and a proximal end to provide a limit to a depth of receipt for the plurality of cards within the receptacle. Each receptacle is oriented such that a direction from the distal end to the proximal end is angularly offset from vertical about a fore/aft axis relative to the base for customer access of at least one of the plurality of cards.

According to at least another embodiment, a display assembly is provided with a base, and at least three arrays of receptacles supported by the base. Each of the receptacles of the at least three arrays is sized to receive a plurality of cards. Each of the receptacles has an opening for display, receipt and removal of at least one of the plurality of cards. A central array of the at least three arrays has a quantity of receptacles that is different than the other arrays to create a non-rectangular overall profile to the at least three arrays.

According to at least another embodiment, a display system is provided with a frame, and a plurality of display assemblies, each corresponding to a style of colors. Each display assembly is provided with a base, and at least three arrays of receptacles supported by the base. Each of the receptacles of the at least three arrays is sized to receive a plurality of cards. Each of the receptacles has an opening for display, receipt and removal of at least one of the plurality of cards. A central array of the at least three arrays has a quantity of receptacles that is greater than the other arrays to create a non-rectangular overall profile to the at least three arrays. The display assembly is provided with at least three more arrays of receptacles supported by the base. Each of the receptacles of the at least three more arrays is sized to receive a plurality of cards. Each of the receptacles has an opening for display, receipt and removal of at least one of the plurality of cards. A central array of the at least three more arrays has a quantity of receptacles that is greater than the other arrays to create a non-rectangular overall profile to the at least three more arrays.

According to at least another embodiment, a display assembly is provided with a base, and a first plurality of receptacles supported by the base. Each receptacle of the first plurality of receptacles is sized to receive a first plurality of cards. Each receptacle of the first plurality has an opening for display, receipt and removal of at least one of the first plurality of cards. A second plurality of receptacles is supported by the base. Each receptacle of the second plurality of receptacles is sized to receive a second plurality of cards. Each receptacle of the second plurality has an opening for display, receipt and removal of at least one of the second plurality of cards. The second plurality of receptacles is oriented relative to the first plurality of receptacles to provide an obtuse angle between display surfaces of the first plurality of cards and the second plurality of cards.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
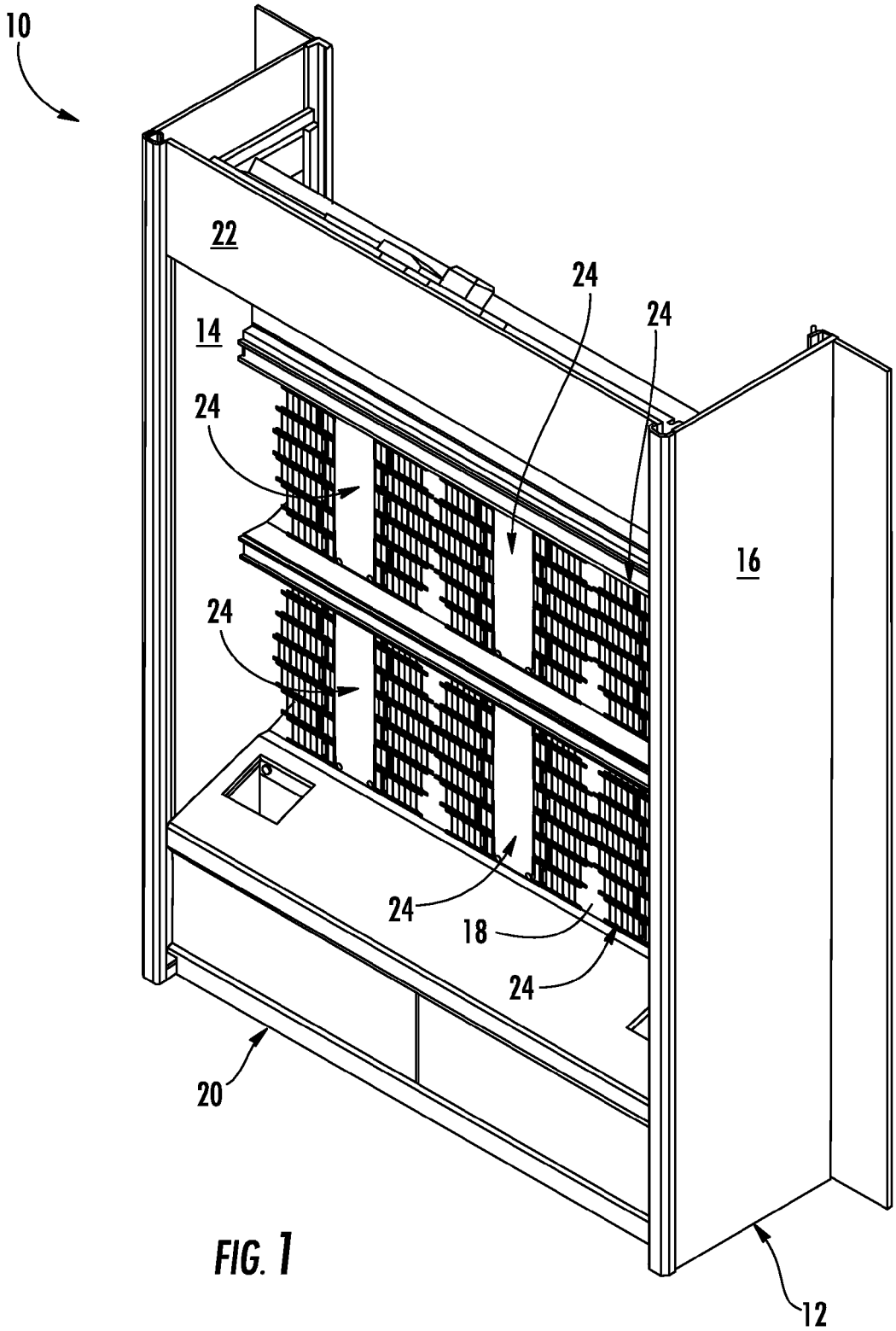
FIG. 1 is a perspective view of a display system according to an embodiment.
Figure 2:
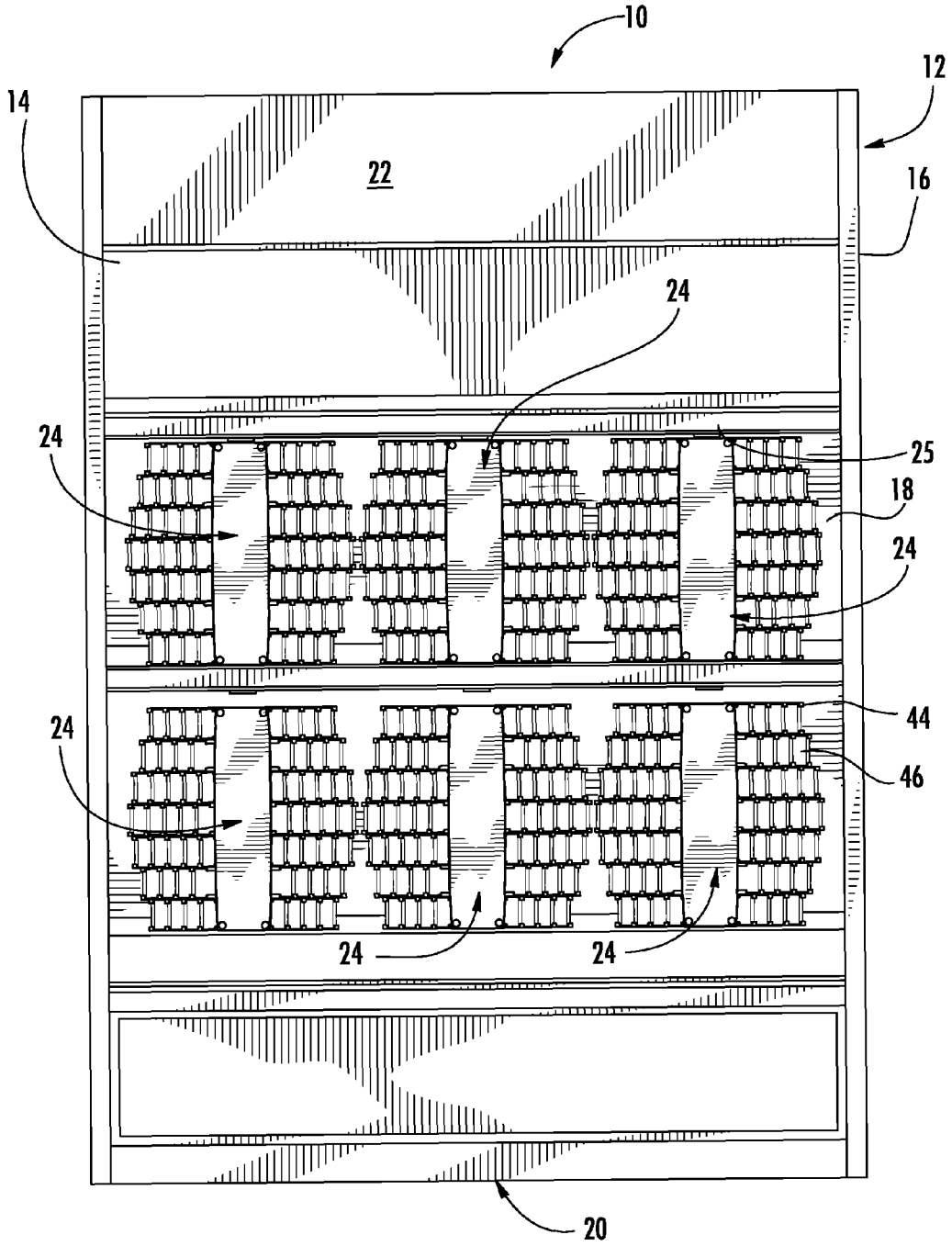
FIG. 2 is a front side elevation view of the display system of FIG. 1.

Paint has historically been marketed at retail by display assemblies and systems of sample paint cards or paint chips. Although various sample paint card shapes have been offered, the displays are often distributed in uniform rows and columns. Referring to FIGS. 1 and 2, a display system is illustrated according to an embodiment; and is referenced generally by numeral 10. Although various display applications are contemplated, the depicted display system 10 is sized to be located at the end of an aisle at a retailer. Such display systems are also referred to as aisle end caps. The display system 10 includes a frame 12 that includes a pair of side panels 14, 16 and a substrate 18. A cabinet 20 is utilized for storage of inventory. A header panel 22 is employed for brand identification.

A plurality of display assemblies 24 are provided in the display system 10. Each display system is organized by, and dedicated to a color style or theme. Although six display assemblies 24 are illustrated, any number of assemblies 24 and corresponding themes, styles or the like, is contemplated. The display assemblies 24 avoid the conventional row and column format in order to aesthetically convey a distinct category for each assembly 24 by isolated geometric patterns that are easily identifiable as separate from other adjacent assemblies 24. The display assemblies 24 also avoid conventional arrangements in order to attract the customers' eyes by geometric patterns that appear to radiate from each centrally-identified theme. A light source 25 may be provided above each display assembly 24 for illumination of the display assembly 24.

Figure 5:
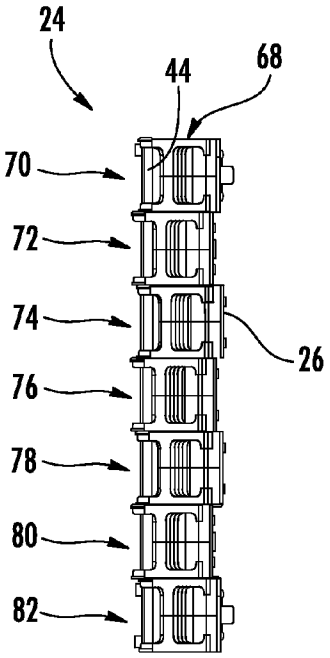
FIG. 5 is a side elevation view of the display assembly of FIG. 3.
Figure 4:
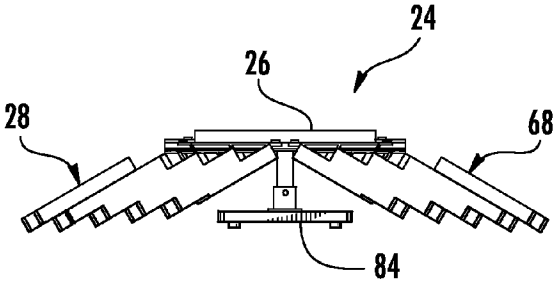
FIG. 4 is a top plan view of the display assembly of FIG. 3.
Figure 3:
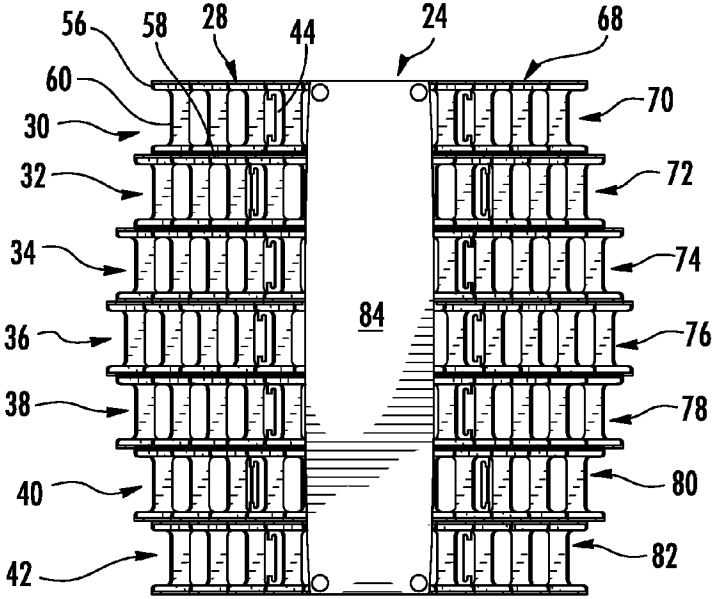
FIG. 3 is a front side elevation view of a display assembly of the display system of FIG. 1, according to an embodiment.

FIGS. 3-5 illustrate one of the display assemblies 24 in greater detail according to an embodiment. Each display assembly 24 includes a base 26 that is mounted to a front face of the substrate 18 of the frame 12. A first series 28 of arrays 30, 32, 34, 36, 38, 40, 42 of receptacles 44 is supported on the base 26. Each receptacle 44 is sized to receive a plurality of paint sample cards 46. Each receptacle 44 has a distal end 48 with an opening 50 for receipt and removal of the paint sample cards 46. Additionally, the openings 50 are also sized to display the paint sample cards 46 from the display assembly 24.

Figure 6:
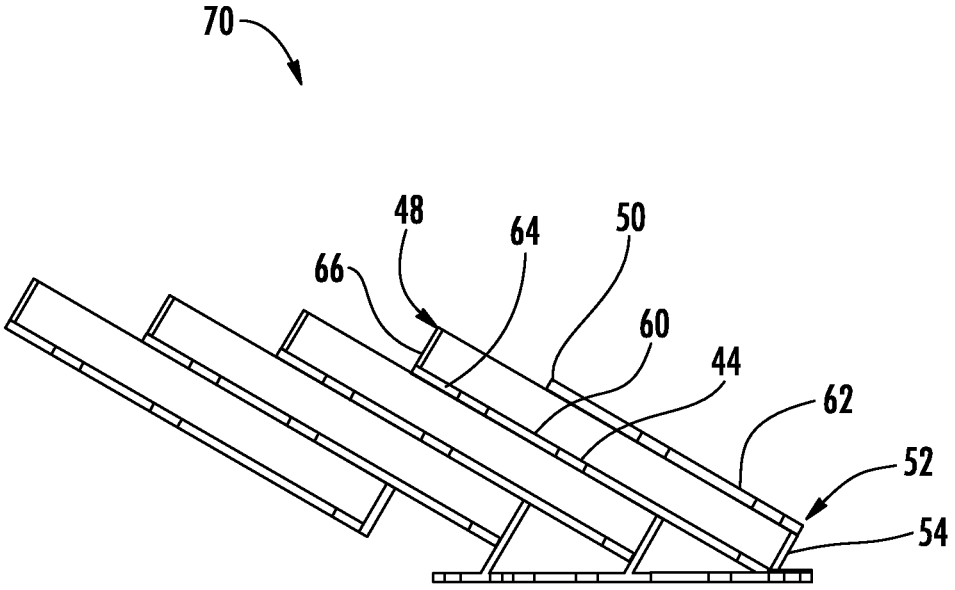
FIG. 6 is a section view of a portion of the display assembly of FIG. 3.

Referring to FIG. 6, each receptacle 44 includes a proximal end 52 to provide a limit to a depth of receipt for the plurality of cards 46 within the receptacle 44. Unlike the prior art, the receptacles 44 are not oriented vertically or inclined from vertical about a horizontal axis. In contrast, the receptacles 44 are oriented horizontally and inclined about a vertical axis for improved customer access. The distal ends 48 are inclined away from the substrate 18 in a forward direction, so that a customer can remove a paint sample card 46 by a motion that is in a lateral direction, and more ergonomic than vertically away from the customer.

With reference now to FIGS. 3-6, each array 30, 32, 34, 36, 38, 40, 42 is oriented so that the receptacles 44 are generally parallel within each array 30, 32, 34, 36, 38, 40, 42. Sequential receptacles 44 within each array 30, 32, 34, 36, 38, 40, 42 overlap with the distal end openings 48 exposed to display the paint sample cards 46.

Structurally, each receptacle 44 includes a proximal wall 54 to provide the limit to the depth of receipt for the plurality of cards 46. A pair of sidewalls 56, 58 extends from the proximal wall 54. A support wall 60 is connected to the proximal wall 54 and the pair of sidewalls 56, 58. A display wall 62 is connected to the proximal wall 54 and the pair of sidewalls 56, 58. The display wall 62 is spaced apart from the support wall 60 for forming a cavity 64 for receipt of the paint sample cards 46. The opening 48 is formed in the display wall 62. As illustrated in FIG. 6, the display walls 62 and the support walls 60 of sequential receptacles 44 can be formed integral for reduction of material. Each receptacle 44 includes a distal wall 66 connected to the support wall 60 and the pair of sidewalls 56, 58 for retaining the plurality of cards 46.

With reference again to FIG. 3, the arrays 30, 32, 34, 36, 38, 40, 42 decrease in number from the central array 36 to the outboard arrays 30, 42 to provide a non-rectangular overall profile to the display assembly 24. Additionally, sequential arrays 30, 32, 34, 36, 38, 40, 42 are offset transversely to prevent alignment of adjacent receptacles 44. As depicted in FIG. 5, parallel offsets in the base 26 horizontally offset the sequential arrays 30, 32, 34, 36, 38, 40, 42 in a fore/aft direction to further prevent alignment of adjacent receptacles 44. These misalignments provide, or this staggering provides a visual effect akin to movement alluded to by static structures. The misalignment and staggering in combination with the tapering arrays 30, 32, 34, 36, 38, 40, 42 illustrate a geometric pattern familiar to a honeycomb structure.

A second series 68 of arrays 70, 72, 74, 76, 78, 80, 82 is provided spaced apart and opposed to the first series 28 with an obtuse angle therebetween. The second series 68 can employ the same characteristics of the first 28 yet in mirrored opposition for symmetry. Signage 84 may be provided on the base 26 in between the first and second series 28, 68 of arrays 30, 32, 34, 36, 38, 40, 42, 70, 72, 74, 76, 78, 80, 82 to label and/or provide information regarding the style, theme, colors or other information regarding the associated display assembly 24. The angled series 28, 68 of receptacles provides a concave aesthetic appeal to the display assembly 24 with the signage 84 at a focal point, with the receptacles 44 appearing to radiate outward from the signage 84.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A display assembly comprising:

a base having a front for customer access and a rear; and a plurality of receptacles supported by the base, each of the plurality of receptacles being sized to receive a plurality of cards, each of the plurality of receptacles having a distal end with an opening for display, receipt and removal of at least one of the plurality of cards and a proximal end to provide a limit to a depth of receipt for the plurality of cards within the receptacle, wherein each receptacle is oriented such that a direction from the distal end to the proximal end is angularly offset from the base about a vertical axis for customer access of at least one of the plurality of cards;

wherein each receptacle is oriented such that the distal end is spaced apart from the proximal end in a direction from the rear to the front, and the distal end is forward relative to the proximal end for customer access of at least one of the plurality of cards; and wherein each receptacle comprises:

an upright proximal wall to provide the limit to the depth of receipt for the plurality of cards, a pair of horizontal sidewalls extending from the proximal wall;

a support wall connected to the proximal wall and the pair of sidewalls, a display wall connected to the proximal wall and the pair of sidewalls, and spaced apart from the support wall, wherein the opening is formed in the display wall spaced forward of the proximal end relative to the base to limit receipt and removal of the plurality of cards to horizontal receipt and removal only, and a distal wall connected to the support wall and the pair of sidewalls to retain the plurality of cards.

2. The display assembly of claim 1 wherein the plurality of receptacles are inclined with the distal end away from the base.

3. The display assembly of claim 1 wherein the plurality of receptacles are oriented horizontally.

4. The display assembly of claim 3 wherein each of the plurality of receptacles are oriented with the opening facing horizontally to permit horizontal receipt and removal of at least one of the plurality of cards.

5. The display assembly of claim 1 wherein the plurality of receptacles are oriented generally parallel and partially offset to overlap sequential receptacles while exposing the distal end openings.

6. The display assembly of claim 1 wherein the display walls and the support walls of sequential receptacles are integral.

7. The display assembly of claim 1 further comprising the plurality of cards representative of paint samples.

8. The display assembly of claim 7 further comprising paint corresponding to the plurality of cards.

9. The display assembly of claim 1 wherein the receptacle extends behind the display wall to partially retain the plurality of cards behind the display wall.

10. The display assembly of claim 1 wherein the base extends vertically.

11. A display assembly comprising:

a base;

at least three arrays of receptacles supported by the base, each of the receptacles of the at least three arrays being generally equally sized to receive a plurality of cards, each of the receptacles having an opening for display, receipt and removal of at least one of the plurality of cards, wherein a central array of the at least three arrays has a quantity of receptacles that is different than the other arrays to create a non-rectangular overall profile to the at least three arrays;

wherein the central array has a quantity of receptacles greater than the other arrays; and at least three more arrays of receptacles supported by the base, each of the receptacles of the at least three more arrays being sized to receive a plurality of cards, each of the receptacles having an opening for display, receipt and removal of at least one of the plurality of cards, wherein a central array of the at least three more arrays has a quantity of receptacles that is greater than the other arrays to create a non-rectangular overall profile to the at least three more arrays.

12. The display assembly of claim 11 wherein the at least three arrays are oriented horizontally.

13. The display assembly of claim 11 wherein the central array is offset from the other arrays so that receptacles of sequential arrays are not aligned.

14. The display assembly of claim 11 further comprising signage supported upon the base between the at least three arrays and the at least three more arrays.

15. A display system comprising:

a frame; and a plurality of display assemblies according to claim 14, each display assembly corresponding to a style of colors.

16. A display assembly comprising:

a base;

a first plurality of receptacles supported by the base, each receptacle of the first plurality of receptacles being sized to receive a first plurality of cards, each receptacle of the first plurality having an opening for display, receipt and removal of at least one of the first plurality of cards;

a second plurality of receptacles supported by the base, each receptacle of the second plurality of receptacles being sized to receive a second plurality of cards, each receptacle of the second plurality having an opening for display, receipt and removal of at least one of the second plurality of cards, wherein the second plurality of receptacles are oriented relative to the first plurality of receptacles to provide an obtuse angle between display surfaces of the first plurality of cards and the second plurality of cards;

wherein each of the first plurality of receptacles and each of the second plurality of receptacles are oriented with the opening facing horizontally to permit horizontal receipt and removal of at least one of the plurality of cards and to prevent vertical receipt and removal of the plurality of cards;

signage mounted to the base between the first plurality of receptacles and the second plurality of receptacles; and wherein the first plurality of receptacles, the signage, and the second plurality of receptacles collectively provide a concave appearance.

* * * * *